US006644664B2

(12) United States Patent
Muir et al.

(10) Patent No.: US 6,644,664 B2
(45) Date of Patent: Nov. 11, 2003

(54) GAMING MACHINE WITH DISCRETE GAMING SYMBOLS

(75) Inventors: Robert Linley Muir, Sydney (AU); Nicholas Luke Bennett, Sydney (AU); Natalie Jane Bryant, Sydney (AU)

(73) Assignee: Aristocrat Technologies Australia Pty Ltd., Lane Cove (AU)

( * ) Notice: Subject to any disclaimer, the term of this patent is extended or adjusted under 35 U.S.C. 154(b) by 203 days.

(21) Appl. No.: 09/756,964

(22) Filed: Jan. 9, 2001

(65) Prior Publication Data

US 2001/0016513 A1 Aug. 23, 2001

(30) Foreign Application Priority Data

Jan. 18, 2000 (AU) ..... PQ5142

(51) Int. Cl.[7] ..... A63F 9/24

(52) U.S. Cl. ..... 273/146; 463/17; 463/18; 463/20; 463/21; 463/22; 463/16; 273/138.1; 273/138.2; 273/143 R

(58) Field of Search ..... 463/16, 20, 21, 463/22, 25, 9–17; 273/138.2, 138.1, 143 R, 146, 139, 292, 293, 142 R

(56) References Cited

U.S. PATENT DOCUMENTS

| | | | | | |
|---|---|---|---|---|---|
| 6,120,378 | A | * | 9/2000 | Moody et al. | 273/143 R |
| 6,123,333 | A | * | 9/2000 | McGinnis et al. | 273/146 |
| 6,126,542 | A | * | 10/2000 | Fier | 273/138.2 |
| 6,173,955 | B1 | * | 1/2001 | Perrie et al. | 273/138.2 |
| 6,213,876 | B1 | * | 4/2001 | Moore, Jr. | 463/22 |
| 6,336,860 | B1 | * | 1/2002 | Webb | 463/22 |

* cited by examiner

*Primary Examiner*—A. L. Wellington
*Assistant Examiner*—Yveste Cherubin
(74) *Attorney, Agent, or Firm*—Katten Muchin Zavis Rosenman

(57) ABSTRACT

A gaming machine includes a controller for controlling operation of a game played on the gaming machine. A display is provided on which a game played under the control of the controller is displayed, the game displayed on the display comprising a plurality of polyhedral elements, each of which has a plurality of faces with a predetermined indicium being carried on at least one face of each element. The elements are rotatable, when the game is played, about at least one axis to bring certain faces into view, the rest positions of the faces and the indicia carried on visible faces of the polyhedral elements being amongst the determining conditions as to whether or not a winning result has been achieved in the game.

10 Claims, 4 Drawing Sheets

GAMING MACHINE WITH DISCRETE GAMING SYMBOLS

FIELD OF THE INVENTION

This invention relates to a gaming machine. More particularly, the invention relates to a gaming machine of the type commonly known as a slot machine, a fruit machine or a poker machine. The gaming machine, in accordance with the invention, has discrete gaming symbols.

BACKGROUND TO THE INVENTION

Players who regularly play gaming machines quickly tire of the same games. Hence, it is important for gaming machine manufacturers regularly to update games played on the gaming machines both to retain customer loyalty and to attract new customers.

With increasing deregulation of the market, more and more venues are opening up which offer patrons the opportunity of playing gaming machines. Hence, it is important for operators of such venues to retain their customers and to attract new customers. This, to a large extent, is governed by the games offered on their gaming machines.

SUMMARY OF THE INVENTION

According to the invention, there is provided a gaming machine which includes:

a control means for controlling operation of a game played on the gaming machine: and a display means on which a game played under the control of the control means is displayed, the game displayed on the display means comprising a plurality of polyhedral elements, each of which has a plurality of faces with a predetermined indicium being carried on at least one face of each element, the elements being rotatable, when the game is played, about at least one axis to bring certain faces into view, the rest positions of the faces and the indicia carried on visible faces of the polyhedral elements being amongst the determining conditions as to whether or not a winning result has been achieved in the game.

In a preferred embodiment of the invention, the display means is a video display unit. Thus, each polyhedral element may be a video simulation of such polyhedral element.

Each polyhedral element may be at least cubic in shape or, if desired, may have more than 6 sides.

For ease of explanation, the invention will be described with reference to cubic elements.

Each element may be rotatable about at least two axes so that each of the faces of the element can be brought into view.

Further, each element may be displayed in a three dimensional format so that at least three faces are visible. For example, a front face, a top face and a side face may be visible when each element ceases spinning about its axes. Then, depending of the configuration of the control means, prizes may be awarded for at least one of winning combinations of indicia on top faces of the elements and winning combinations of indicia on side faces of the elements, in addition to prizes being awarded for winning combinations of indicia on front faces of the elements.

The polyhedral elements may be arranged in a matrix and prizes may be awarded depending on active paylines in a similar manner to that of spinning reel gaming machines. The paylines may be arranged vertically. horizontally and in a zigzag manner through the elements.

Where each element represents a die and the indicia are dots representing the numbers "one" to "six" on the faces of the die, prizes may be awarded on a payline for the sum of the numbers visible on corresponding faces of the elements, for example, only on the front face of the elements. Still further a prize may be awarded for the product of predetermined indicia, for example, the product of certain numbers or the product of an indicium multiplied by a multiplier.

As a refinement of the invention, a predetermined event may trigger a bonus condition in which at least one of the elements "opens" to reveal a bonus prize contained in said element.

BRIEF DESCRIPTION OF THE DRAWINGS

The invention is now described by way of example with reference to the accompanying drawings in which.

DETAILED DESCRIPTION OF THE DRAWINGS

Figure 1:
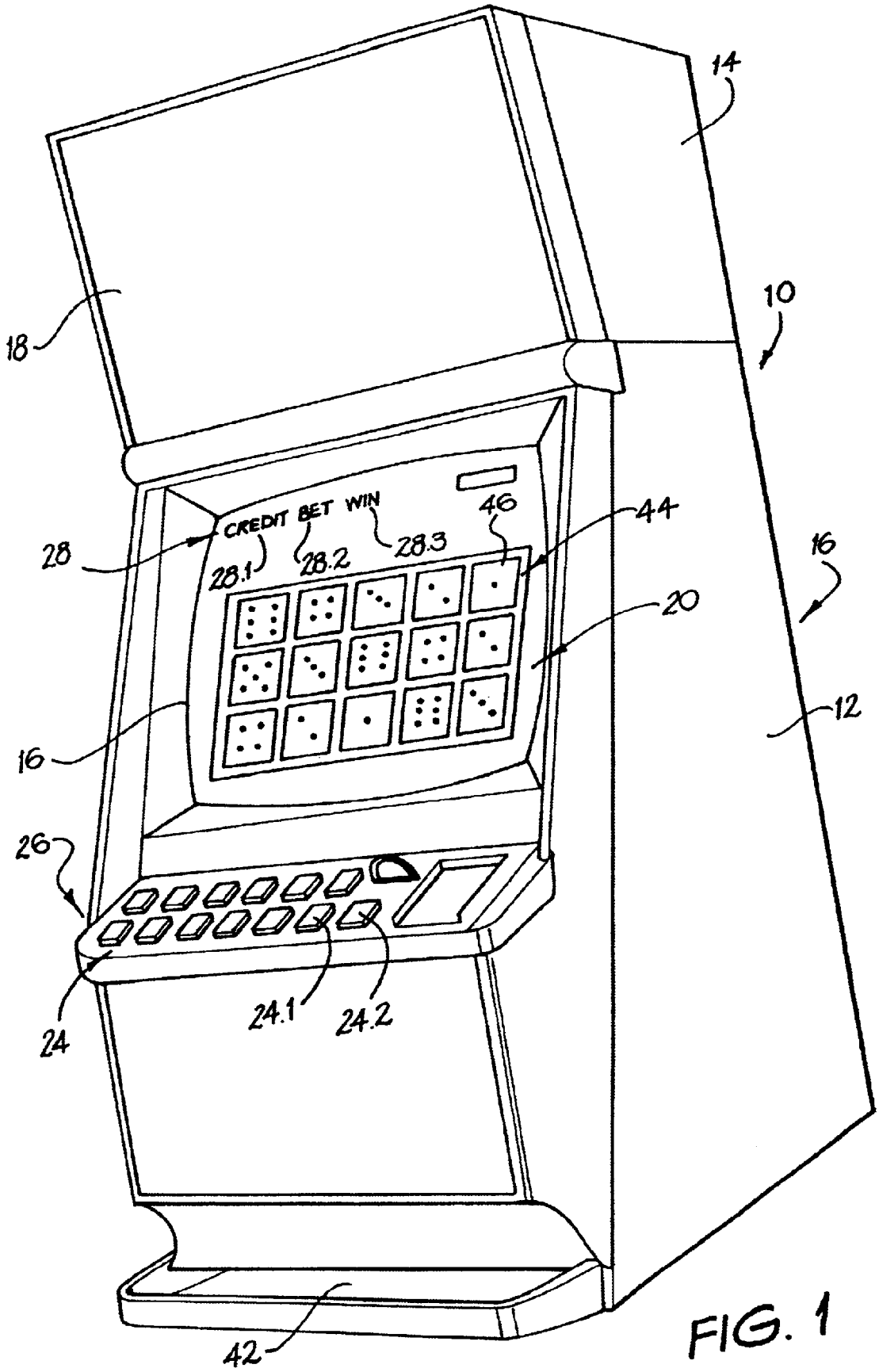
FIG. 1 shows a three dimensional view of a gaming machine, in accordance with the invention.

In the drawings, reference numeral 10 generally designates a gaming machine, in accordance with the invention. The gaming machine 10 includes a console 12 on which a top box 14 is mounted. A video display unit or screen 16 is mounted in the console 12. Artwork 18 is mounted in the top box 14. The artwork 18 carries a paytable and related information to advise a player on winning combinations etc.

A game 20 in use, is displayed on the screen 16. The game 20 will be described in greater detail below.

To play the game 20. a bank of buttons 24 is arranged on a midtrim 26 of the gaming machine 10. Various operations are effected by the buttons 24 such as, via buttons 24.1 and 24.2, the number of lines to be bet and the number of credits to be bet, respectively. Various meters 28 are also displayed on the screen 16. A first meter 28.1 indicates the credits available to the player as a result of previous wins. A meter 28.2 shows the bets made by the player for a particular game or games and a meter 28.3 shows the amount won by the player as a result of a winning combination of symbols or indicia in the game 20.

Figure 2:
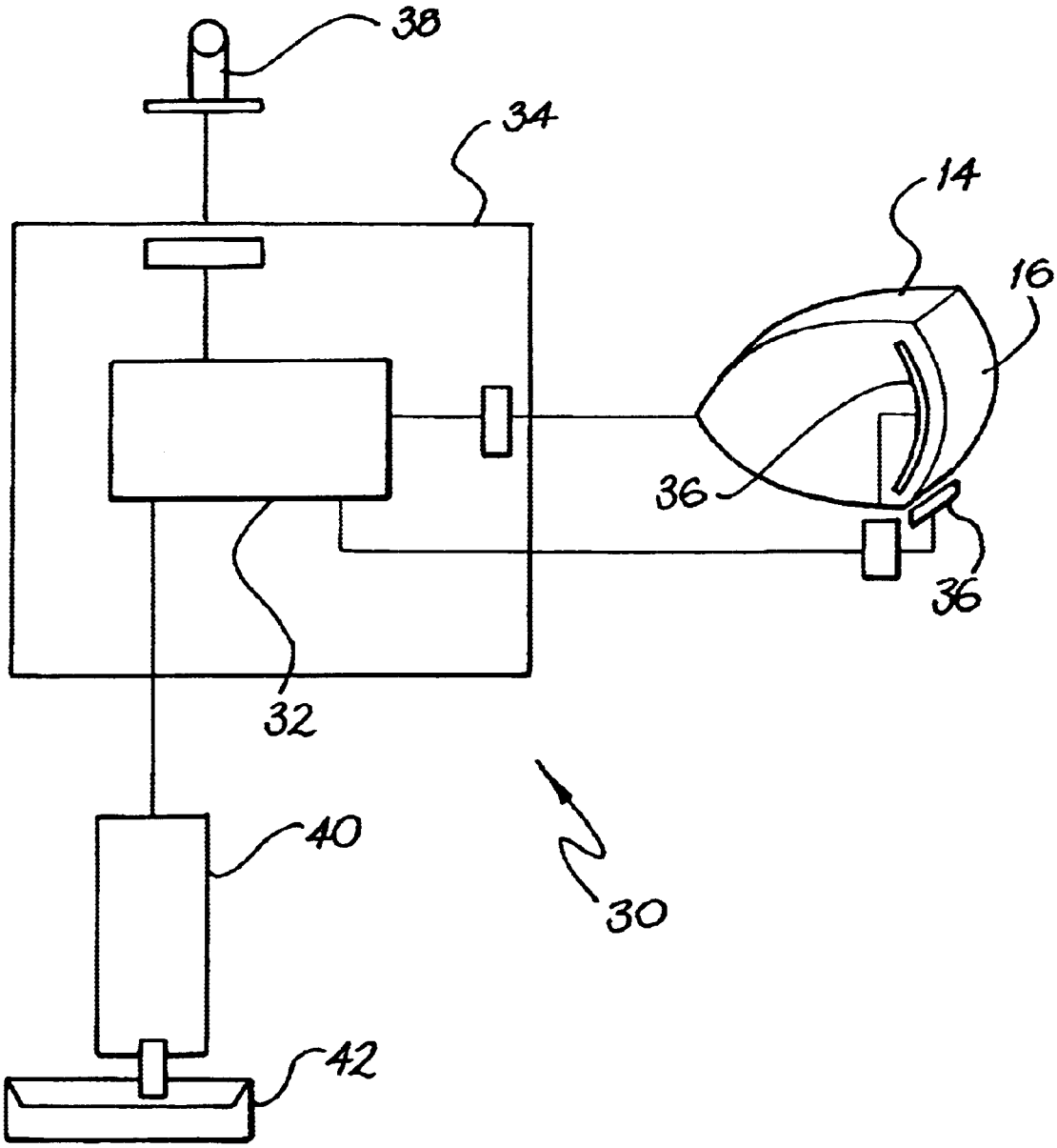
FIG. 2 shows a block diagram of a control means of the gaming machine.

Referring now to FIG. 2 of the drawings, a control system 30 of the gaming machine 10 is illustrated. A program which implements the game 20 is run on a processor 32 of the control system 30. The processor 32 forms part of a controller 34 which drives the screen 16 and receives input signals from sensors 36. The sensors 36 include touch sensors mounted in the screen 16. The sensors 36 cooperate with the buttons 24 for causing symbols displayed on the screen 16 in the playing of the game 20 to "spin" as will be described in greater detail below.

The controller 34 also receives input pulses from a mechanism 38 indicating that the player has provided sufficient credit to begin playing. The mechanism 38 may be a coin input chute, a bill collector, a credit card reader, or other similar types of validation devices. Finally, the controller 34 also drives a payout mechanism which, for example, may be a coin output 40 for feeding coins to a coin tray 42.

The game 20 is constituted by symbols in the form of polyhedral elements 44 and, more particularly, cubic elements. Each cubic element 44 thus has six faces 46.

Figure 4:
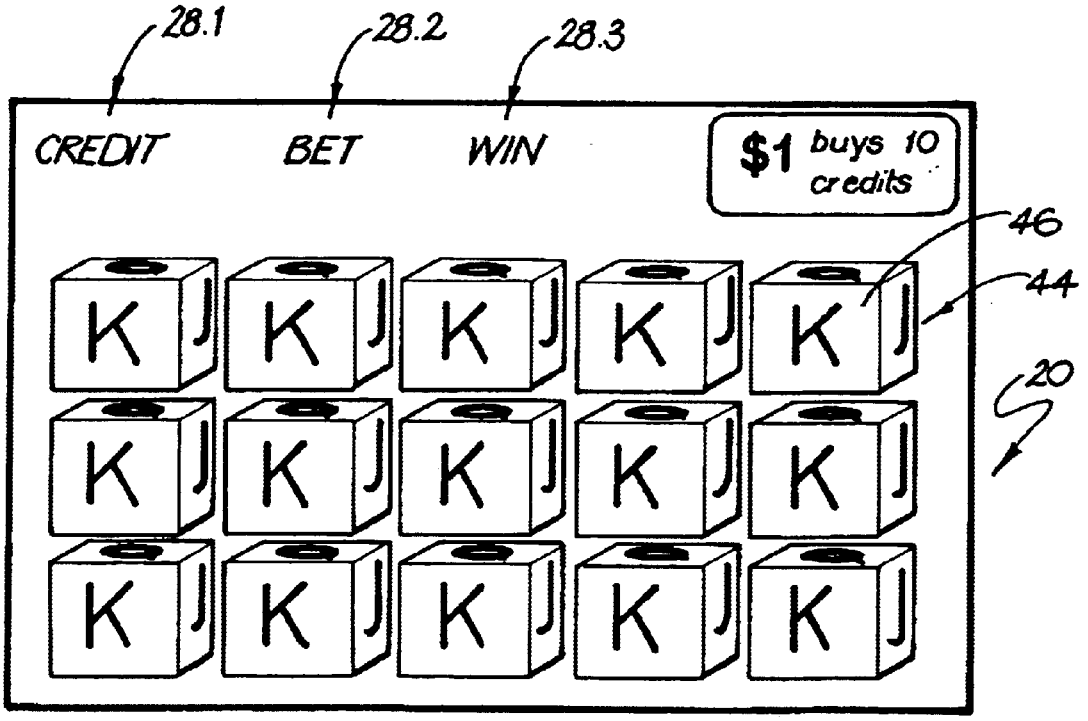
FIG. 4 shows a schematic representation of a second embodiment of the display of the gaming machine.
Figure 5:
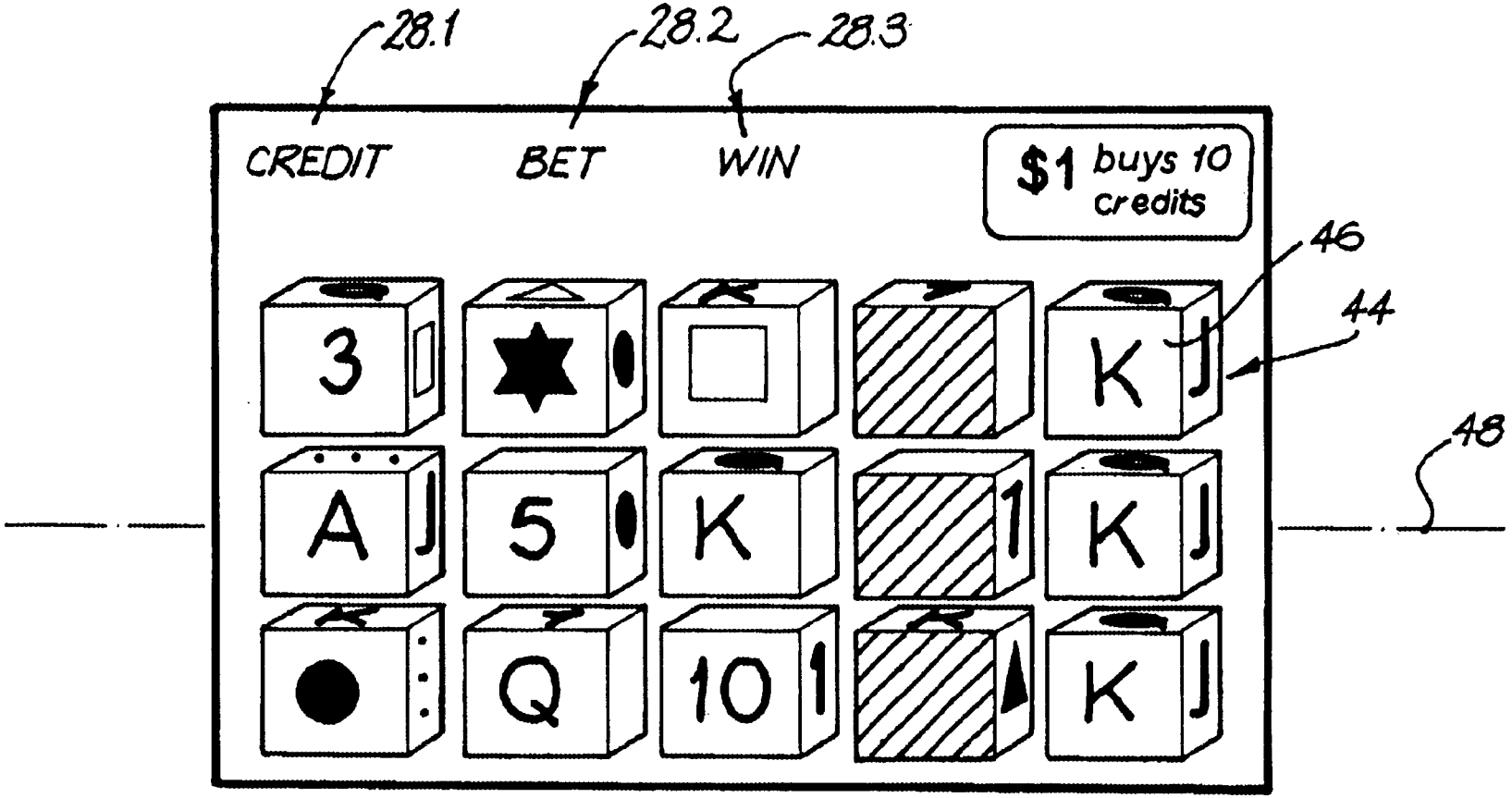
FIG. 5 shows a schematic representation of yet a further embodiment of a display of the gaming machine.

Various embodiments of the game will now be described with reference to FIGS. 3 to 5 of the drawings. Instead of spinning reels, the polyhedral elements 44 are used. Each element 44 is able to spin about a horizontal axis and a vertical axis to bring one of its faces 46 into view. In addition, the elements 44 are arranged in a three dimensional or perspective manner so that more than one face 46 is visible. Hence, as shown in FIGS. 3 to 5 of the drawings, a front face, a top face and a side face 46 of each element 44 are visible.

Figure 3:
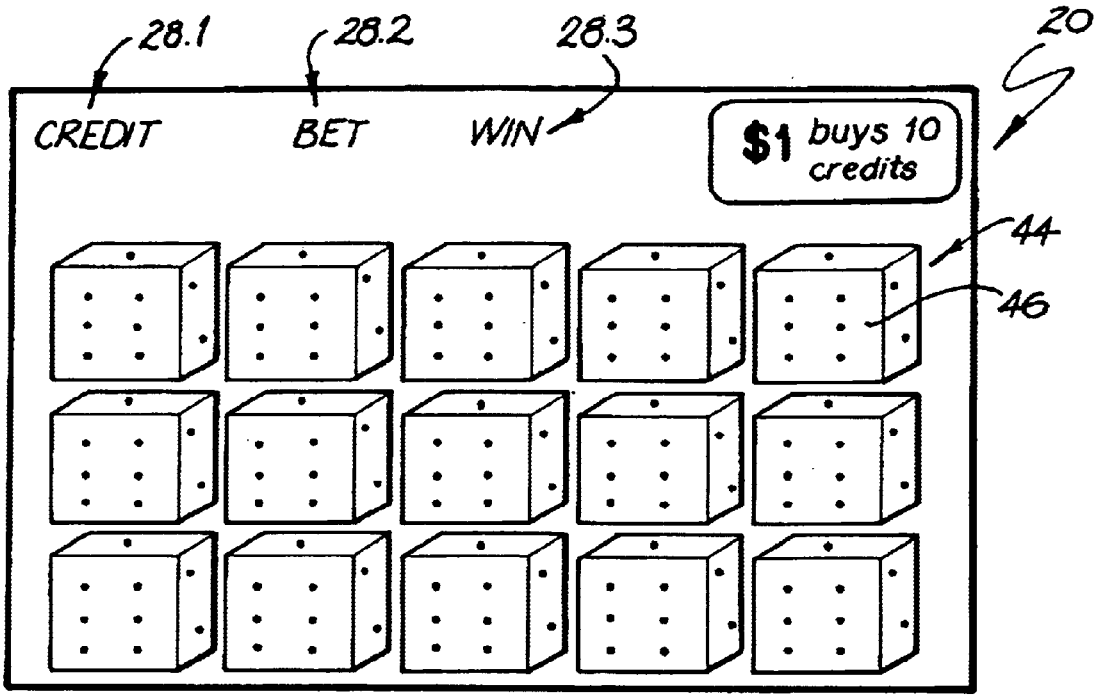
FIG. 3 shows a schematic representation of one embodiment of a display of the gaming machine.

As illustrated in FIG. 3 of the drawings, each element 44 is a representation of a die. Instead, as shown in FIGS. 4 and 5, each element 44 may carry various other indicia on its faces 46.

Prizes are paid to the player depending on the combination that is spun up on one or more of the elements 44. The winning combinations could be patterns of numbers or symbols similar to spinning reel games, or could be a function of the numbers, or could be as a result of poker-type hands, or the like. It will be appreciated that the ways in which winning combinations are determined are much more numerous and versatile than in the case of conventional spinning reels games, poker games, keno or bingo games, or the like. For example, winning patterns could be displayed on the paytable and could apply when they come up anywhere on the screen or on specified paylines.

In another embodiment, particularly with reference to FIG. 3 of the drawings, the prizes could relate to the sum of the numbers on all or a subset of the dice. For example, if the sum of a row is greater than 20 then a prize of 500 credits may apply whereas a sum of 16 to 19 may pay 100 credits, etc.

In FIG. 3, the game 20 shows a typical 3×5 layout as commonly found in a spinning reel game as applied to a dice game. Thus, the elements 44 represent dice. Paylines pass through the elements 44 in the conventional manner, bearing in mind that zigzag paylines are also possible and prizes are awarded depending on winning combinations appearing on the paylines.

However, in addition, in this game the sum of the dots on the front faces 46 of the elements 44 may also pay prizes. Hence, the total sum on the faces of five dice making up a payline award predetermined prizes such as:

| Total | Prize/Credits |
|---|---|
| 30 | 10000 |
| 25 to 29 | 100 |
| 20 to 24 | 50 |
| 15 to 19 | 10 |
| 10 to 14 | 5 |
| 5 | 5000 |

Referring now to FIG. 4 of the drawings yet a further embodiment is shown. In this case, indicia on the faces 46 of the elements 44 are standard spinning reel-type indicia. Horizontal, vertical and zigzag paylines are applicable to this game 20. In addition, indicia on the side faces and top faces also result in winning combinations if they appear on the relevant paylines. Still further, wins may be achieved for scatter-type combinations.

Referring finally to FIG. 5 of the drawings yet a further embodiment of the game is shown. In this embodiment, there are many possibilities as to how the results may be interpreted and prizes paid and a multi-step process is employed. In this process a win may be determined by a symbol and a number. Looking at a centre payline 48, in the first column an "A" indicium appears on the face 46 of the element 44. Adjacent to it, in the second column, an indicium "5" appears. Then the product of the these two is applicable to award a prize for 5×A. The black faces 46 in the fourth column may serve as wild cards so that, once again, on payline 48 a prize for 3×K is payable if a right-to left payout is also applicable.

In addition, the vertical pattern in the fourth column and in the fifth column may pay prizes. In respect of the fifth column there is the possibility of three prizes being paid for 3×K, 3×Q and 3×J by incorporation of all the visible faces.

For embodiments where the elements 44 are represented with the appearance of being three dimensional objects, there could be an animation sequence that simulates the opening of the elements 44 as if they are boxes. Thus, predetermined trigger conditions or winning combinations are defined such that, if they appear, then one or more of the elements 44 will "open up" to reveal the prize that is to be awarded. Instead, bonus symbols may be shown on one or more faces 46 of one or more of the elements 44. In addition to standard pays, any time that the bonus symbol is revealed that face 46 opens to reveal an instant bonus prize.

Hence, the star in the second column in the display shown in FIG. 5 of the drawings may be a bonus symbol such as the automatic payment of a prize of 100 credits. The prize is revealed to the player by the symbol 46 "opening up".

Hence, it will be appreciated that by having polyhedral elements or elements 44 instead of spinning reels, a large number of possibilities for gaming machine games is possible with a wide variety to suit players and to maintain interest of the players.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The claims defining the invention are as follows:

1. A gaming machine which includes:

a control means for controlling operation of a game played on the gaming machine; and a display means on which a game played under the control of the control means is displayed, the game displayed on the display means comprising a plurality of polyhedral elements, each of which has a plurality of faces with a predetermined indicium being carried on at least one face of each element, the elements being rotatable, when the game is played, about at least one axis to bring certain faces into view, the rest positions of the faces and the indicia carried on visible faces of the polyhedral elements being amongst the determining conditions as to whether or not a winning result has been achieved in the game and each element being displayed in a three dimensional format so that at least three faces are visible and prizes being awarded for at least one of winning combinations of indicia on top faces of the elements and winning combinations of indicia on side faces of the elements, in addition to prizes being awarded for winning combinations of indicia on front faces of the elements.

2. The gaming machine of claim 1 in which the display means is a video display unit.

3. The gaming machine of claim 2 in which each polyhedral element is a video simulation of such polyhedral element.

4. The gaming machine of claim 1 in which each polyhedral element is at least cubic in shape.

5. The gaming machine of claim 4 in which each element is rotatable about at least two axes so that each of the faces of the element can be brought into view.

6. The gaming machine of claim 1 in which, where each element represents a die and the indicia are dots representing the numbers "one" to "six" on the faces of the die, prizes are awarded on a payline for the sum of the numbers visible on corresponding faces of the elements.

7. The gaming machine of claim 1 in which a prize is awarded for the product of predetermined indicia.

8. The gaming machine of claim 1 in which a predetermined event triggers a bonus condition in which at least one of the elements opens to reveal a bonus prize contained in said element.

9. The gaming machine of claim 1 in which the polyhedral elements are arranged in a matrix and prizes are awarded depending on active paylines in a similar manner to that of spinning reel gaming machines.

10. The gaming machine of claim 9 in which the paylines are arranged vertically, horizontally and in a zigzag manner through the elements.

* * * * *